United States Patent [19]

Jarrett

[11] 4,390,829

[45] Jun. 28, 1983

[54] SHUNT VOLTAGE REGULATOR CIRCUIT

[75] Inventor: Robert B. Jarrett, Tempe, Ariz.

[73] Assignee: Motorola, Inc., Schaumburg, Ill.

[21] Appl. No.: 269,184

[22] Filed: Jun. 1, 1981

[51] Int. Cl.[3] ..... G05F 3/18

[52] U.S. Cl. ..... 323/231; 123/623; 323/313; 323/315

[58] Field of Search ..... 323/226, 229–231, 323/313, 315, 316; 307/296 R, 297; 123/623, 651, 652

[56] References Cited

U.S. PATENT DOCUMENTS 4,329,639 5/1982 Davis ..... 307/297

FOREIGN PATENT DOCUMENTS 1463270 12/1968 Fed. Rep. of Germany ..... 323/313
1563663 4/1970 Fed. Rep. of Germany ..... 323/231
2000697 7/1970 Fed. Rep. of Germany ..... 323/313

OTHER PUBLICATIONS

IBM Technical Disclosure Bulletin, vol. 15, No. 5, pp. 1590–1591.

*Primary Examiner*—William H. Beha, Jr.
*Attorney, Agent, or Firm*—Michael D. Bingham

[57] ABSTRACT

A series shunt regulator circuit suitable to be fabricated in monolithic circuit form for providing a regulated output voltage and having a low input to output voltage differential thereacross. The regulator is comprised of a passive PNP current mirror circuit including a pair of PNP emitter area ratio transistors whereby the collector current of the output transistor of the pair of PNP transistors which is coupled in series with the output of the regulator circuit is equal to the value of N times the collector current of the second one of said pair of PNP transistors where N is the ratio of the emitter areas. A constant current source sinks a small reference current from the second transistor such that the output current from the regulator circuit is equal to the value N times this reference current. A Zener diode is connected in shunt with the output of the regulator circuit for regulating the output voltage whenever the unregulated supply voltage is greater than the avalanche breakdown voltage characteristic of the diode.

3 Claims, 1 Drawing Figure

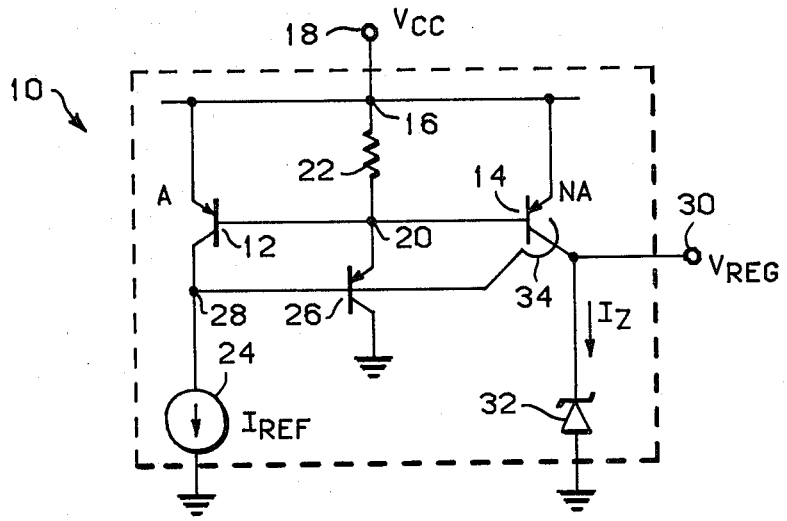
18
VCC
10
16
22
14
A
NA
30
12
20
VREG
34
28
26
IZ
24
32
IREF

SHUNT VOLTAGE REGULATOR CIRCUIT

BACKGROUND OF THE INVENTION

1. Field of the Invention

This invention relates to regulator circuits and, more particularly, to a PNP series shunt integrated regulator circuit having a low input/output voltage differential.

2. Description of the Prior Art

In an attempt to improve the gas mileage of today's internal combustion engines, the automobile industry is increasingly relying on monolithic integrated circuit electronic ignition systems for controlling engine sparking. Generally, the automobile manufacturer has required these ignition systems to be able to operate with a battery operating potential that can vary between five to 80 volts, conditions which correspond to low battery starting and load dump respectively. This requirement has necessitated the use of a regulator circuit internal to the solid state ignition circuit to provide a constant supply voltage to operate the individual components and circuitry of the ignition system.

One type of regulator circuit used in some prior art ignition systems is the shunt regulator which includes a resistor coupled in series with a zener diode both of which are fabricated internally to the integrated ignition circuit with the resistor being coupled via an external terminal to the car battery. The regulated voltage is taken from across the Zener diode to operate the circuitry comprising the ignition system. A problem arises with this type of regulator in that a minimum supply voltage and load current is required to operate the ignition system which, typically, are four volts and between three to ten milliamps. In order to provide four volts when the car battery is five volts the series resistor can be no larger than 100 ohms if ten millamps of current is to be provided. Thus, assuming that a ten volt Zener diode is used for regulation, under the 80 volts load dump condition a minimum of 700 milliamps will flow therethrough which means that 7 watts must be dissipated under the load dump condition by the Zener. This is very undesirable as the integrated circuit cannot be safely operated. Therefore, there is a need to replace the shunt regulator as used in some prior art ignition system with some other type of regulator circuit.

A series pass NPN transistor type of regulator, although not suffering from the power dissipation problems of the shunt regulator, requires a NPN device having both a large $BV_{CEO}$ breakdown and a low input/output voltage characteristic which are not easily obtained using today's integrated circuit processing techniques. Therefore, in order to withstand the 80 volts supply voltage under load dump conditions which requires a high $V_{CEO}$ breakdown, the input to output differential of the series pass device due to the $V_{CE}$ sat characteristics and base current drive component thereof at 5 volts is not low enough to provide the 4 volts minimum to the integrated ignition system.

Thus, a need exists for a low input/output differential regulator circuit that is suitable to be fabricated in monolithic integrated circuit form and which can be operated from an unregulated potential that varies over a wide range in magnitude while both supplying a minimum output voltage at an output thereof and dissipating minimal power.

SUMMARY OF THE INVENTION

Accordingly, it is an object of the present invention to provide an improved regulator circuit.

Another object of the present invention is to provide an improved low input/output differential series shunt regulator circuit.

Still another object of the present invention is to provide a low input/output differential series shunt regulator circuit suitable to be fabricated in integrated circuit form.

In accordance with the above and other objects there is provided a series shunt regulator circuit suitable to be manufactured in integrated circuit form comprising a passive current mirror including a pair of PNP transistors the emitters of which are commonly connected to a terminal at which is supplied a source of unregulated operating potential, the bases of which are commonly connected together and coupled to said terminal, with the collector of the first one of said pair of PNP transistors being coupled to an output of the regulator circuit and further including a source of current which is coupled to the collector of the other one of said pair of transistors for sourcing a substantially constant current therefrom and a Zener diode coupled between the output terminal of the regulator circuit and a terminal at which is supplied a reference potential; the emitter area of said first PNP transistor being N times greater than the emitter area of said second PNP transistor wherein the collector current of said first PNP transistor is N times the value of said constant current.

DESCRIPTION OF THE DRAWING

The single FIGURE is a schematic diagram of the preferred embodiment of the invention.

DETAILED DESCRIPTION OF THE PREFERRED EMBODIMENT

Series shunt regulator 10 of the present invention which is suitable to be fabricated in integrated circuit form is illustrated in the single FIGURE within the dashed outline. Regulator 10 comprises a pair of PNP transistors 12 and 14 connected as a simple passive current mirror whereby the current conducted through transistor 14 is caused to be proportional to the current conducted through transistor 12. The emitters of transistors 12 and 14 are commonly connected at node 16 to receive an unregulated voltage that is applied to external terminal 18. The bases of transistors 12 and 14 are commonly connected at node 20 and via resistor 22 to node 16. The collector of transistor 12 is coupled to current source 24 which sources a small constant current from this transistor. Base cancellation current transistor 26 is shown with its base and emitter coupled between nodes 28 and 20 and its collector coupled to a source of constant potential and functions in a known manner to reduce inaccuracies in the current mirror due to beta variations between transistors 12 and 14 where beta is the forward current amplification factor of the transistors. The output of regulator 10 is taken at node 30 and is coupled in series to the collector of transistor 14 and in shunt to Zener diode 32. Transistor 14 is indicated as having a secondary P-type semiconductor ring 34 formed about the collector thereof; the structure of which is known to those skilled in the art. P-type semiconductor ring 34 collects minority carriers which otherwise tend to be injected into the epitaxial region of the integrated circuit whenever transistor 14 is operated in a saturated condition.

For explanation purposes only, and without limiting the scope of the present invention, if regulator 10 is to be utilized to provide voltage and current to operate an integrated electronic ignition circuit, the unregulated potential $V_{CC}$ corresponds to the car battery voltage and as aforementioned can vary from 5 to 80 volts. Regulator 10 of the present invention as will be explained, operates with minimal voltage differential between the input and output thereof such that at 5 volts input thereto a sufficient voltage potential is supplied to output terminal 30 to operate the ignition system in conjunction with sufficient current being supplied from output 30. As shown, the emitters of transistors 14 and 12 are area ratioed with the area of transistor 14 being N times the area of transistor 12 such that under ideal conditions the collector current of transistor 14 is N times the value of the collector current of transistor 12. Therefore, the magnitude of current flowing from the collector of transistor 14 is equal to $NI_{ref}$. An assumption is made that $NI_{ref}$ is always greater than the worst case anticipated load current to be supplied at output terminal 30. For example, if the load current required by the electronic ignition system is three milliamps, making $I_{ref}$ equal to 400 microamps and N equal to the constant 10, a collector current of four milliamps flows from transistor 12 to source three milliamps to the load and one milliamp to bias Zener diode 32. If Zener diode 32 is a seven volt device, for instance, a regulated output voltage of seven volts is supplied at output 30 when VCC is 12 volts or greater.

Under load dump conditions, $V_{CC}$ approximately equal to 80 volts, regulator 10 suffers none of the disadvantages of the prior art because of the use of lateral PNP transistors which typically have large BVCEO breakdown voltages. In the present example, as the battery voltage is decreased to approximately 7.1 volts, transistor 14 becomes saturated. Although Zener diode 32 can no longer regulate the output voltage at output 30, transistor 14 continues to source three milliamps to the load with secondary P-type ring 34 of the transistor collecting the current that otherwise is injected into the substrate. Therefore, with the VCE sat voltage of transistor 14 being approximately equal to 100 millivolts, an output voltage of 4.9 volts is supplied at output terminal 30 under low battery conditions (5.0 volts) with regulator 10 providing a load current of three milliamps.

Thus, what has been described, is a novel PNP series shunt voltage regulator circuit that can provide a predetermined load current in response to an unregulated voltage supplied at the input thereof the magnitude of which can vary over a wide range. The regulator has very low voltage differential between inputs and outputs such that a useful output voltage is provided at the output of the regulator under minimal unregulated voltage inputs to the regulator. Therefore the present invention does not suffer limitations of series pass PNP closed loop regulators, i.e., compensation stability problems, ringing and etc. Furthermore, the present invention is much simpler to implement successfully in integrated circuit form.

In one embodiment of the invention the regulator has been used to provide a minimum load current of approximately three milliamps and a useful output voltage for operating an adapted dwell electronic ignition system coupled to the output of the regulator with an input voltage applied thereto that varied from 5 to 80 volts.

I claim:

1. A monolithic integrated regulator circuit for providing a regulated voltage at an output thereof in response to an unregulated voltage supplied thereto whenever the magnitude of the unregulated voltage is greater than a predetermined value but less than a predetermined maximum value and having a minimum voltage differential between the input and output thereof, comprising:

a first PNP transistor having an emitter region, a base region and a collector region, said emitter region being coupled to the input of the regulator circuit;

a second PNP transistor having an emitter region, a base region and a collector region, said emitter region having an area N times greater than the area of said emitter region of said first PNP transistor and being coupled therewith, said base region being coupled to said base region of said first PNP transistor, said collector being coupled to the output of the regulator circuit;

a current source coupled to said collector region of said first PNP transistor for sourcing a current therefrom;

a Zener diode coupled in shunt to the output of the regulator circuit; and collector circuit means coupled to said current source for collecting current that otherwise would be injected into the substrate of the integrated regulator circuit when said second PNP transistor becomes saturated wherein the current flow through said first transistor is reduced.

2. The regulator circuit of claim 1 including a third PNP transistor having an emitter region, a base region and collector region, said emitter region being coupled to said base region of said first PNP transistor, said base region being coupled to said collector region of said first PNP transistor, said collector region being maintained at a constant potential.

3. The regulator circuit of claim 2 wherein said collector circuit means is a secondary P-type collector ring in spaced relationship to said collector region of said second PNP transistor.

* * * * *